United States Patent [19]

Böder

[11] 4,285,663

[45] Aug. 25, 1981

[54] PROCESS AND APPARATUS FOR THE CONTINUOUS BURNING OF A FUEL

[76] Inventor: Wilfried Böder, Sulenstrasse 23, 3013 Barsinghausen, Fed. Rep. of Germany

[21] Appl. No.: 38,896

[22] Filed: May 14, 1979

[30] Foreign Application Priority Data

May 16, 1978 [DE] Fed. Rep. of Germany ..... 2821367

[51] Int. Cl.[3] ..... F23N 5/18

[52] U.S. Cl. ..... 431/76; 431/8

[58] Field of Search ..... 431/8, 76

[56] References Cited

U.S. PATENT DOCUMENTS

| | | | |
|---|---|---|---|
| 3,074,644 | 1/1963 | Geniesse | 431/76 |
| 3,357,375 | 12/1967 | Brophy | 431/8 |
| 3,503,583 | 3/1970 | Schomaker | 431/76 |
| 4,138,725 | 2/1979 | Ikemoto | 431/76 |
| 4,162,889 | 7/1979 | Shigemara | 431/76 |
| 4,174,943 | 11/1979 | Reed | 431/76 |

*Primary Examiner*—George E. Lowrance

*Attorney, Agent, or Firm*—Darby & Darby

[57] ABSTRACT

In a process and apparatus for the continuous burning of a fuel, the fuel is run into a combustion space where it is burnt after being ignited, making use of oxygen-containing gas run into the space. The relation of gas to fuel is changed dependent on the adjustment, of a desired oxygen content in the flue gas current. For making certain of an unchanging combustion power, the fuel inlet rate is controlled to be directly dependent on the adjustment of the oxygen content in the flue gas while keeping up an unchanging rate of input of oxygen-containing gas into the combustion space.

14 Claims, 2 Drawing Figures

PROCESS AND APPARATUS FOR THE CONTINUOUS BURNING OF A FUEL

BACKGROUND OF THE INVENTION (1) Special field of the invention

The invention relates to a process and an apparatus for the continuous burning of a fuel in the case of which the fuel is run into a combustion space, in which, after being ignited, it is burnt using oxygen-containing gas run into the combustion space and the relation of gas to fuel is charged so as to be dependent on the control of a desired oxygen content in the flue gas current.

(2) The prior art

In the case of past designs of burner systems, medium is jetted or sprayed into a combustion space, using a nozzle head and burnt, after ignition, using oxygen let into the combustion space. For running in the oxygen, air is sucked using a separate blower and forced into the combustion space (so-called "burner air"). The burner air has to have a certain relation to the heating value of the fuel used in the special case on hand (air relation number) to make certain of the desired combustion.

In this respect burner systems of the prior art make use of compound automatic control with respect, on the one hand, to the amount of fuel run in and, on the other, the amount of air or oxygen used. The desired compound values are, in each case, fixed using mechanical compound automatic controllers. Because, however, the heating value of a certain fuel is not able to be truly classified at the time of combustion, it is never possible to say certainly that at the time of combustion itself the value of the fuel will not be different to the average heating or burning value, for which the adjustment of the system has been made. This is true for all fuels, that is to say, as well, for natural gas and gas coming through long-distance pipelines. In order, even with these chances of having different values, to make certain of keeping up continuous combustion, in burner systems of the prior art operation takes place with excess air to make certain that combustion does not take place under substoichiometric conditions. However, even the use of such excess air all the time makes for many effects which are undesired: for example the sucked-in ballast air (that is to say the oxygen which is run into the combustion space in addition for reasons of safe operation and which may not be burnt), is heated and moved past all heating faces and then goes out of the system as an increased emission factor. A further undesired event is that in the "firing space" (radiation combustion chamber) the flame temperature is lowered by the presence of such excess air with the outcome that there is a marked decrease in the desired heat transmission in the producing or heating system. For these reasons it has furthermore not so far been possible for several fuels to be burnt at the same time in a given firing system with compound automatic controllers; all "combination burners" have an "all or none" operation unit. For this reason the apparatus is made markedly more complex and there are shortcomings with respect to safe operation and in the engineering side of operation; if a combination firing system, generally run on a certain fuel and only designed with a connection for an other fuel to make for safe running, is, after a long time, started up with the other fuel, then it will be seen that, because of the long time in which this other fuel has not been used, trouble will be in some cases very likely, more specifically with respect to the mechanical side of automatic control (cocks, pumps, etc.).

Furthermore, in the case of power stations of great size, it is old for oxygen analyzers to be used in the flue gas duct coming after the combustion process. Using these analyzers, the compound automatic controllers, (which are used because the air rate is dependent on the fuel rate, and not the other way round) undergo adjustment with a moving servo-member for automatic control of the excess air (while keeping to an unchanging combustion power) with an unchanging input rate of fuel. Because, however, volumetric control of gas currents is not readily possible and a, generally speaking, long automatic control lag is necessary in this case, this old process for adjustment of the (mechanical) compound automatic controller may only be used on a very limited scale with good effect in fullsize plant. The base-teaching used so far of an unchanging fuel input rate (or keeping to an unchanging, desired power) and the running in of further air as needed with a marked air excess, was kept to in this old process as well.

OVERVIEW OF THE INVENTION

Taking these teachings of the prior art as a starting point, one purpose of the present invention is that of making such a better design of a process for the continuous combustion of a fuel in the way noted earlier that, generally speaking, while keeping clear of the noted shortcomings of old combustion processes, it is possible to make certain of combustion under specially even and useful combustion conditions, and with a specially high efficiency, even if there are great changes in the heating value of the fuel used. Furthermore an apparatus of the sort noted earlier for the continuous combustion of a fuel, is to be made so much better in design that the use of the different sorts of fuels is to be made possible at any time without troublesome changes being necessary, while making certain of very safe operation and of a specially high level of the relation between output and costs, this being so even in the case of very great changes in the heating values of the fuel which is at the time being used. Furthermore the system is to be, generally speaking, simple in design.

In the case of a process of the sort noted earlier this purpose and other purposes are effected by the invention in that, for making certain of an unchanging combustion power, the fuel input rate is directly controlled dependent on the controlled level of the desired oxygen content, the input of oxygen-containing gas in the combustion space being kept unchanging. The apparatus of the invention for the continuous combustion of a fuel is based on a burner with a burner space, which has a unit for the input of fuel and a unit for blowing in an oxygen-containing gas, in the case of which, furthermore, there is an instrument, acted upon by the flue gas, for measuring the oxygen content in the flue gas; in this respect the purpose of the apparatus of the invention is effected by such an apparatus because the blowing-in unit for the oxygen-containing gas is designed as a unit—on operation with an unchanging combustion power—with an unchanging blowing rate, whose adjustment is possible, and the fuel input unit has a rate controller, whose adjustment is directly possible to be dependent on the oxygen measuring instrument in the flue gas current.

So in the process of the invention, quite unlike processes of the prior art, the air, or the oxygen-containing gas, is run in as a way of automatically controlling power and as a guiding material, and, on these lines, any desired fuel medium with any desired heating value is run into the input air going into the system, till the automatic control point in the flue gas is got to. Because of this it is possible to make full and specially high-level use of present-day power source materials which are high in quality and, furthermore, in price.

With the apparatus of the invention it is possible for fuels coming from the most different places and with completely different heating values to be burnt in a burner system at any time and without any great changes in the plant being necessary. It is, for example, even readily possible to make use of such fuel materials with a high efficiency, and which have great changes in their heating value, from waste and residue processes, the changes being for example from between 2000 and 10,000 kcal/kg.

In accordance with a useful development of the process of the invention, the measuring of the content of oxygen still in the flue gas takes place at a position coming after the flame, where flue gas temperatures are between 600° C. and 900° C. (that is to say at positions which are still within the burner space itself but, not within the part taken up by the flame), because at this position the $O_2$ partial pressure and the temperature are linearized, so that in the case of the use of Nernst cells the $O_2$ may be specially well measured.

Automatic control to get an unchanging, desired oxygen content still in the flue gas current, that is to say an unchanging residual oxygen content, in which respect the $O_2$ content is more specially kept at a figure below 2.5% by vol., and, more specially, still control to a value of about 1% vol., makes combustion near to the stoichiometric point (but in the post-stoichiometric range) possible. It is even possible with the process of the invention for the oxygen content in the flue gas to undergo adjustment to a reference value of about 0.5% vol., or less, in which respect it is still possible in all cases for the somewhat post-stoichiometric conditions to be kept to truly for reasons of safe operation in view of the time lag of automatic control systems and regulations with respect to emissions. In one further development of the process of the invention of good effect, the oxygen rate of input of oxygen-containing gas into the combustion space, and which is kept unchanging at the time of combustion, is able to undergo adjustment; this makes readily possible any desired automatic control of the power of the burner. As an oxygen-containing gas use is more specially made of air. The process of the invention, unlike the case of prior art burner systems, makes possible combustion with better conditions and, for this reason, a better relation between output and costs. Furthermore, combustion may take place even nearer to the stoichiometric point than has so far been possible, because high-speed, true automatic control of fuel input is made possible; because of this a marked saving in energy is possible in comparison with prior art burner systems while running at the same power level. It is furthermore to be noted that in the case of operation, made possible by the invention, of combustion processes near the stoichiometric point all emissions of damaging materials may very readily be controlled at the flue gas end (in fact, in the case of $O_2$ excesses in the flue gas at a figure not greater than 2.5% vol. hardly any damaging substances (CO, $CO_2$) were to be measured). On building burner plants of the prior art, for example for burning light heating oil, design has so far been based on the necessary air relation (or air ratio) number. In the case of an air input, taken to be stoichiometric, of 11.5 normal cubic meters/kg and an air relation number of 1.2, 13.7 cubic meters of air will be needed for the combustion of 1 kg of heating oil (heating value 10170 kcal/kg). Based on such average values, the necessary (mechanical) compound automatic control system is designed. The burner power is then fixed to be in line with the fuel need (for example a "burner power" of 112 to 115 kg of oil for producing an amount of heat of 1 G cal). Normal burners are classified on these lines. On the other hand, on designing a burner system using the present invention the important figure is not the figure for power automatic control with respect to the fuel need, but with respect to the air input rate whose selection has been made. The oxygen content (worked out by subtraction of the residue oxygen content) for the combustion of the fuel, then undergoes the addition, automatically controlled, of the necessary amount of fuel (amount of energy) in which respect the loss in efficiency because of the input of further, ballast air, is decreased nearly to zero. So, on using a process in line with the present invention for producing the same amount of heat of 1 G cal, for which—as has been made clear earlier—in the case of a prior art burner about 112 to 115 kg of oil are needed, it is possible to make do with about 7 kg of oil less. In a further development of the process of the invention of good effect, it is furthermore possible for different fuels to be forced into the combustion space at the same time and it is possible for the input rate of the separate fuels to be controlled so as to be dependent on the automatic control of the given, desired oxygen content level in the flue gas to be in line with a desired compound control system. In systems in which there is the input of different fuels into the combustion space, the automatic control of the residual content of oxygen in the flue gas is naturally made more complex. On changes taking place in this value, it would be necessary, dependent on the compound automatic control system, whose adjustment is made beforehand, to undertake control of the different fuel input rates; in this respect there must be a fixed order, that is to say an order of priorities, with respect to control of the different fuel inputs within the framework of a desired compound control system. In a specially simple compound control system of good effect there is a control, taking place at the same time and put linearly in line, of the input of all fuels when the true controlled condition or value becomes different to the desired one. The outcome of this is in fact that there will be an even opening up, or shutting off of all fuel input rates at the same time, when an automatic control operation is started.

If, however, the fuels used have very different heating values, it may be useful, if the true oxygen content in the flue gas is not in line with the desired content, for only the input of one separate fuel to be controlled and, if the limit of possible control is got to, then for the next fuel input to be controlled afterwards, an so on. In this respect it is best for the compound control system for the separate fuel inputs to be so designed that they may be controlled in line with a fixed control order.

As an instrument for measuring the oxygen content in the flue gas, it is possible to make use of any oxygen-measuring unit with a short reaction time and of the necessary design, as for example instrument on the market designed like a mass-spectroscope (quadrupole mass-spectrographs) or designed like other forms of spectroscopes (ESR (electron spin resonance) spectroscopes), in an apparatus of the present invention. It is, however, specially simple for the apparatus of the invention to be designed if the instrument in the flue gas has a part producing the control signal, going to the input rate control unit, as a Nernst voltage signal between the residual oxygen content in the flue gas and the oxygen content of a boxed-up comparison gas volume. In this respect a useful effect is to be produced if the part in question has a (more specially shut-off) primary chamber for the volume of comparison gas, a secondary chamber, open to the flue gas, for the volume of test gas (that is to say the gas whose content is to be measured), Nernst solid state cells, running out into the primary and secondary chambers, and acted upon by the oxygen contents in each case, and a comparison unit for measuring the potential difference between the electrochemical oxygen potentials measured by the two Nernst solid state cells. The measure of profiting from the Nernst effect in view of the potential difference of the electrochemical potentials of the oxygen contents in the starting up air (before combustion) and in the flue gas (after combustion) makes possible a simple, low-price oxygen measuring system, which is quite as desired with respect to the accuracy (as needed for automatic control) and speed. It is best for such a probe to be fixedly placed in the connection zone (of the flue gas) downstream from the radiation space (combustion space) at a position at which the flue gas temperatures in question are between 600° and 900° C. In the case of such an oxygen measuring instrument in the post-stoichiometric ranges noted, which are more specially used in the invention, voltages between 37 and 54 mV may be used, in which respect, on getting to the stoichiometric point, an increase in the voltage dynamically to 500 and more mV will be noted. Dependent on the increase in the oxygen excess in the flue gas there is a parallel voltage drop, getting to a value of zero, when the reference oxygen and the oxygen at the secondary side of the probe are present in the same amounts. On using such Nernst solid state cells it is possible, in a simple way, to make certain of very true automatic control and furthermore a marking of limit values for the purpose of shutting down, necessary to put an end to any dangers in operation, and furthermore in the case of a very marked drop in the voltage.

LIST OF FIGURES

Using the diagrammatic figures the teachings of the invention will now be made clear, by way of example, in more detail.

DETAILED ACCOUNT OF WORKING EXAMPLES OF THE INVENTION

Figure 1:
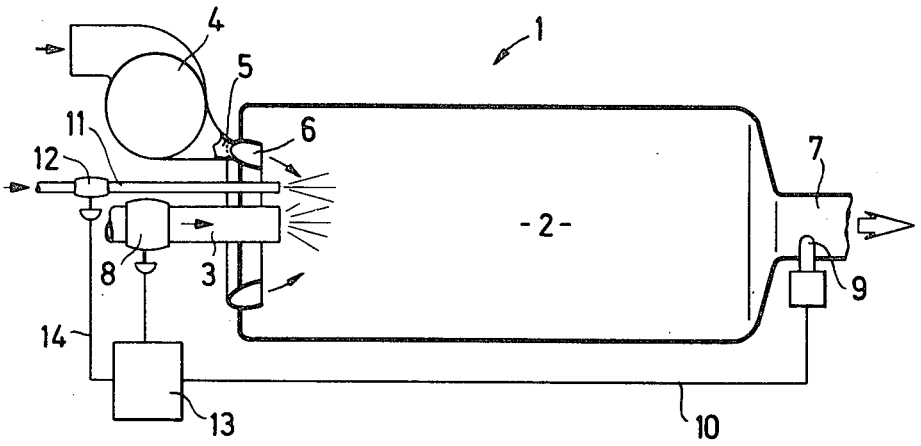
FIG. 1 is a diagrammatic view of a burner structure using the present invention.

In FIG. 1 a burner is to be seen with a combustion space 2, at whose output end there is a flue gas duct 7 for taking off the gases of combustion. At the front end of the burner 1 there is a unit 3 for the input of fuel medium as desired into the combustion space 2 by jetting or in any other way. Furthermore, at the input end of the burner 1 there is an air fan 4, which, by way of an input duct 5, is responsible for input of the fanned-in air to a unit 6 for blowing the air into the combustion space 2. For this unit 6 the most different forms of design have been put forward in the prior art and such designs are in fact possible in the present invention. In fact, in FIG. 1 it is only a question of a unit given by way of example and diagrammatically, having an air duct centered on the fuel injection unit 3 and having blades for producing a turning motion of the air. At a position coming after the flame (that is to say in FIG. 1, in the flue gas duct 7, although it might be positioned in the combustion space itself) there is an $O_2$ measuring instrument 9, from which, by way of a line 10, control signals go to an automatic control system 8, by way of which the rate of input of fuel to the combustion space 2 may be automatically controlled.

For operation the fan 4 is first started up, it being so designed that, once running, it keeps up an unchanging air input rate into and through the combustion space 2, the level of the input rate being able to be controlled in line with the desired power at the fan 4. After the air input has been started up in this way, fuel input is started, the fuel being injected using the unit 3 into the combustion space, where it is ignited. Using the oxygen measuring instrument 9 in the flue gas duct 7, the residual oxygen content in the output flue gases is then measured all the time. Dependent on the content of oxygen desired, and as fixed beforehand, still-n the flue gas, using the line 10 on the automatic control system 8, the fuel input is stepped up through the unit 3 into the combustion space 2 till the content of oxygen still in the flue gas has taken on the desired value and, for this reason, the desired combustion conditions are kept to. If the true oxygen content in the flue gas becomes different to the desired value, as fixed beforehand, then at once, using the feeler 9, the necessary adjustment of the input rate control system 8 is undertaken, that is to say the input rate of the pumped fuel is increased or decreased. In addition to the fuel input unit 3, it is furthermore possible to have other, further fuel input units, of which one is to be seen by way of example in FIG. 1; this second fuel input unit 11 is as well designed with an input rate control system 12, which, by way of a control line 14, gets control signals from a distribution automatic controller 13 placed in the output line 10 of the feeler 9. This distribution automatic controller 13 is in respect worked using a desired compound automatic control system, in the case of which, when the true value becomes different to the desired value of control, and the deviation signal goes from the feeler 9 by way of the line 10, the controller 13 is responsible for a certain division-up of the control signals for going to the different fuel input lines. In this respect signals of the same sort may go at the same time to all fuel input lines, something which makes for control of all these lines at the same time for linearly effected, same-function control (that is to say all input lines are opened or shut to the same degree). However, as a further possible control step, it is possible for complete division-up in time of the signals to be undertaken, so that, for example, firstly the supply line 3 for the first fuel is opened up or shut down, and only when the limits of control in this respect have been got to, will the next fuel input line be controlled, and so on.

Figure 2:
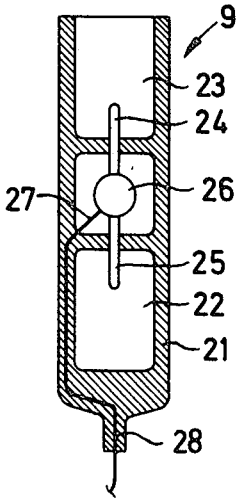
FIG. 2 is a section through the diagrammatic system of a Nernst solid state cell.

FIG. 2 is a section of the most important design points of an oxygen feeler 9, taking the form of a Nernst solid state cell.

This feeler 9 has an outer housing 21 with a chamber 22 shut off inside it, and an outwardly open chamber 23 with the same size. The chamber 22 is full of a reference gas (more specially air), while the open chamber 23 is placed in the current of flue gas and, for this reason, becomes full of flue gas. A sensing part 25 is placed running into the chamber 22 while a sensing part 24 is placed in chamber 23, the sensing parts being designed as Nernst cells for sensing the electrochemical oxygen potentials of the gas volumes in the chamber 22 and, in the other case, in the chamber 23. A unit 26 is joined with the sensing parts 24 and 25 for measuring the potential difference between the electrochemical oxygen potentials as measured by the two Nernst solid state cells 24 and 25, the difference going in the form of a voltage signal by way of line 27 to the output 28 of the instrument 9 and, from this position, by way of line 10 for control of the input rates for the separate fuel input units 3 and 11. The feeler 9, to be seen in FIG. 2 is, however, in the present case only viewed diagrammatically; this is because the details of the structure of the feeler may be changed in a greater number of different respects, for example with respect to the open chamber not being a chamber open at one side or end, but being designed as a chamber with motion of the gas right through it (and having slots at its sides for this purpose). Furthermore the chamber 22 for the reference gas may be in the form of a chamber which is open to the outside (that is to say open towards a chamber of greater size, which is full of the reference gas). Furthermore other instruments may be placed in the feeler 9, for example for heating up the flue gas volume, if the feeler 9 is placed at a position, at which the flue gas temperatures are not high enough, or further units for amplification of the voltage signals, and the like. However, such changes have no effect on the base-form of such a Nernst feeler to be seen in FIG. 2. Such Nernst feelers or cells are marketed at generally low prices, are simple in design and simple to make. Furthermore, they make certain of true measuring of the contents of oxygen in the flue gas.

I claim:

1. A process for the continuous combustion of a fuel comprising the steps of:

introducing a flow of combustible fuel into a combustion chamber;

introducing oxygen-containing gas into said combustion chamber at a predetermined flow rate;

igniting said fuel in the presence of said oxygen-containing gas, thereby creating an exhaust current after combustion;

measuring the oxygen content in said exhaust current; and altering the rate of flow of said fuel into said combustion chamber, without changing the flow rate of said gas, in response to changes in the measured oxygen content in said exhaust current.

2. A process as claimed in claim 1, wherein the measuring of the oxygen content in the exhaust current takes place where the exhaust current has a temperature between 600° and 900° C.

3. A process as claimed in claim 1 or claim 2, wherein the oxygen content in the exhaust current is maintained at a value under 2.5% vol.

4. A process as claimed in claim 3, wherein the oxygen content in the exhaust current is maintained at up to 0.5% vol.

5. The process of claim 3 in which the oxygen content in the exhaust current is maintained to a value of approximately 1% vol.

6. A process as claimed in claim 1 in which said predetermined flow rate of oxygen-containing gas is able to undergo adjustment.

7. The process of claims 1 or 2 in which a plurality of individually controllable flow rates of separate fuels is introduced into the combustion chamber, each of said flow rates being alterable in response to changes in the measured oxygen content of said exhaust current.

8. A process as claimed in claim 7, in which a linear relationship is maintained among the individual rates of flow of all fuels.

9. A process as claimed in claim 7, in which each of said individual fuel flows is altered in accordance with a predetermined order.

10. A process as in claim 1 wherein said oxygen-containing gas is air.

11. An apparatus for the continuous combustion of a fuel, having a combustion chamber in which the fuel is ignited, and means for measuring the oxygen content of exhaust gases after combustion, the apparatus comprising:

means for introducing a flow of combustible fuel to the chamber;

means for introducing a predetermined flow rate of oxygen-containing gas to the chamber; and means for altering the rate of flow of said fuel into the chamber, without changing the flow rate of said gas, in response to changes in the measured oxygen content in the exhaust gases.

12. The apparatus of claim 11, wherein the means for measuring the oxygen content of the exhaust gas comprises a first Nernst solid state cell located in a volume of comparison gas, and a second Nernst solid state cell located in the path of the exhaust gas.

13. The apparatus of claim 12, wherein said measuring means further comprises:

a primary chamber for holding said volume of comparison gas;

a secondary chamber, open to the exhaust gas and adapted to hold said second Nernst cell in a location exposed to said exhaust gas; and comparison means for measuring the potential difference between the electrochemical voltage potentials measured by said first and second Nernst cells.

14. The apparatus as claimed in anyone of claims 11 to 13, wherein said measuring means is placed at a position in the exhaust gas, at which the gas temperatures are between 600° and 900° C.

* * * * *